US006922975B1

(12) United States Patent
Shiraishi et al.

(10) Patent No.: US 6,922,975 B1
(45) Date of Patent: Aug. 2, 2005

(54) COSMETIC MATERIAL SHEET AND METHOD FOR MANUFACTURE OF THE SHEET AND APPARATUS FOR USE IN THE MANUFACTURE

(75) Inventors: Nobuo Shiraishi, Odawara (JP); Kazuyuki Mimuro, Kanagawa (JP); Yohei Aonuma, Kanagawa (JP); Yukio Hishinuma, Yokohama (JP); Norio Arai, Fujinomiya (JP)

(73) Assignee: Kanebo Cosmetics, Inc., Tokyo (JP)

( * ) Notice: Subject to any disclaimer, the term of this patent is extended or adjusted under 35 U.S.C. 154(b) by 152 days.

(21) Appl. No.: 09/980,816

(22) PCT Filed: Jul. 19, 2000

(86) PCT No.: PCT/JP00/04869

§ 371 (c)(1),
(2), (4) Date: Feb. 5, 2002

(87) PCT Pub. No.: WO01/05268

PCT Pub. Date: Jan. 25, 2001

(30) Foreign Application Priority Data

Jul. 21, 1999 (JP) ..... 11/206793
Dec. 2, 1999 (JP) ..... 11/343695

(51) Int. Cl.[7] ..... B65B 63/02
(52) U.S. Cl. ..... 53/436; 53/527; 53/246; 53/250
(58) Field of Search ..... 53/411, 436, 473, 53/475, 523, 527, 131.2, 131.3, 133.3, 244, 53/246, 250, 560, 559, 435, 438; 206/823

(56) References Cited

U.S. PATENT DOCUMENTS 2,365,920 A * 12/1944 Vaughn ..... 53/436
2,731,777 A * 1/1956 Wollersheim ..... 53/436
4,884,680 A * 12/1989 Israel et al. ..... 206/823
4,887,410 A * 12/1989 Gandini ..... 53/436
4,962,627 A * 10/1990 Gueret ..... 53/436
5,072,831 A * 12/1991 Parrotta et al. ..... 206/823
5,161,688 A * 11/1992 Muchin ..... 53/452
5,391,420 A * 2/1995 Bootman et al. ..... 424/480
5,406,990 A * 4/1995 Haeberli ..... 53/436
5,704,980 A * 1/1998 Misiano et al. ..... 118/708
5,782,060 A * 7/1998 Greenland ..... 43/452
5,799,675 A * 9/1998 Gunderman et al. ..... 132/333
6,368,721 B1 * 4/2002 Watanabe et al. ..... 428/461

(Continued)

FOREIGN PATENT DOCUMENTS

JP 57-124864 8/1982

(Continued)

*Primary Examiner*—Louis Huynh
(74) *Attorney, Agent, or Firm*—Hogan & Hartson, LLP

(57) ABSTRACT

A cosmetic material sheet which comprises a sheet substrate 1 having, on an upper surface thereof, a large number of concave portions 5 arranged in a checkered pattern, a foundation layer 6 provided at a given position on the upper surface of the sheet substrate 1 in a state of covering arbitrary concave portions 5 out of a large number of concave portions 5, and a protective cover 3 attached releaseably on the upper surface of the sheet substrate 1 in a state of covering the foundation layer 6, wherein each concave portion 5 has an oblong shape in a plan view and has a bottom part thereof formed into a curved plane of a dish shape.

17 Claims, 14 Drawing Sheets

U.S. PATENT DOCUMENTS

| | | | | |
|---|---|---|---|---|
| 6,070,392 | A * | 6/2000 | Berman et al. | 53/440 |
| 6,182,420 | B1 * | 2/2001 | Berman et al. | 53/435 |
| 6,190,730 | B1 * | 2/2001 | Matsos et al. | 156/277 |
| 6,301,860 | B1 * | 10/2001 | Gunderman et al. | 53/410 |

FOREIGN PATENT DOCUMENTS

| | | |
|---|---|---|
| JP | 63-169020 | 11/1988 |
| JP | 04-183404 | 6/1992 |
| JP | 06-4841 | 2/1994 |
| JP | 06-165711 | 6/1994 |
| JP | 06-62916 | 9/1994 |
| JP | 06-315412 | 11/1994 |
| JP | 08-154735 | 6/1996 |
| JP | 08-308633 | 11/1996 |

* cited by examiner

COSMETIC MATERIAL SHEET AND METHOD FOR MANUFACTURE OF THE SHEET AND APPARATUS FOR USE IN THE MANUFACTURE

BACKGROUND OF THE INVENTION

1. Field of the Invention

The present invention relates to a cosmetic material sheet which enables a trial use of a powdery cosmetic such as a foundation, an eye shadow, a cheek color or the like hygienically as a sample, enables a sale thereof as a product and particularly enables a use thereof as a disposable product. The present invention also relates to a method for manufacturing of the same and an apparatus for use in the manufacture.

2. Related Art

Conventionally, in order to contain a sample of powdery cosmetics such as a foundation, an eye shadow, a cheek color or the like, various kinds of sample cases have been marketed. However, all of them have a stereoscopic or three-dimensional shape so that there has been a problem that they are bulky and hence, it is difficult to handle them in transportation or the like.

There exists a conventional thin cosmetic sampler. As shown in FIG. 25, this cosmetic sample includes a cosmetic sample layer 62 having a desired pattern printed on an upper surface of a mount 61 by a screen printing and a transparent protective cover 64 adhered to the upper surface of the mount 61 by way of an adhesive agent layer 63 coated on an outer peripheral portion of the upper surface such that the protective cover 64 can be peeled off. Then, in forming the cosmetic sample layer 62, as cosmetic material which includes the cosmetic sample layer 62, material which dissolves powder which eventually becomes a cosmetic sample in a solvent is used. Then, by printing such a slurry-like cosmetic material on the upper surface of the mount 61 by a screen printing, the solvent in the cosmetic material is evaporated and the cosmetic sample layer 62 remains.

However, the above-mentioned cosmetic sampler uses, as the cosmetic material which constitutes the cosmetic sample layer 62, material which dissolves powder which becomes the cosmetic sample in the solvent and hence, the cosmetic sampler can be used only as a color sample. Further, the color of the cosmetic sample layer 62 does not agree with the color of the cosmetic actually used.

SUMMARY OF THE INVENTION

The present invention has been made in view of the above-mentioned circumstance and it is an object of the present invention to provide a cosmetic material sheet which can offer powdery cosmetic material totally having the same color, gloss and touch as those of powdery material actually used as a sample or the like and can firmly adhere the powdery cosmetic material to a sheet substrate, a method for manufacturing such a cosmetic material sheet and a device used for such a method.

According to one embodiment, a cosmetic material sheet of the present invention includes a sheet substrate having a large number of concave portions formed on an upper surface thereof, a powdery cosmetic material adhering layer formed on the upper surface of the sheet substrate at a given position in a state that the powder cosmetic material adhering layer covers arbitrary concave portions out of a large number of concave portions, and a protective cover which is releaseably adhered to the upper surface of the sheet substrate in a state that the protective cover covers the powdery cosmetic material adhering layer, wherein each concave portion has an oblong shape in a plan view and has a bottom portion thereof formed into a curved plane of a dish shape.

That is, according to the cosmetic material sheet of the present invention, at a given position on the upper surface of the sheet substrate which has a large number of concave portions on the upper surface thereof, the powdery cosmetic material adhering layer is formed in a state that the powdery cosmetic material adhering layer covers arbitrary concave portions out of a large number of concave portions. Accordingly, by using a powdery cosmetic material that is actually manufactured for sale instead of a sample cosmetic material as the powdery cosmetic material which constitutes the above-mentioned powdery cosmetic material adhesive layer, different from a conventional product which uses the sample cosmetic material which is obtained by dissolving powdery cosmetic material actually used in a solvent or the like, it is possible to offer the powdery cosmetic material having the same color, gloss and touch as those of the powdery cosmetic material actually used as a sample. Accordingly, by actually trying out the powdery cosmetic material, a consumer can accurately judge whether the powdery cosmetic material which the consumer is going to purchase has the quality and hue that the consumer desires so that the cosmetic material sheet is useful in promoting the sale of the powdery cosmetic material.

Further, the cosmetic material sheet uses the powdery cosmetic material used as the powdery cosmetic material of the above-mentioned powdery cosmetic material adhering layer and hence, the cosmetic material sheet can be used as a product. Further, the powdery cosmetic material adhering layer is formed in a state that the powdery cosmetic material adhering layer covers the arbitrary concave portions of the large number of concave portions arranged on the upper surface of the sheet substrate and hence, the powdery cosmetic material which constitutes the powdery cosmetic material adhering layer is filled in the above-mentioned arbitrary concave portions. The powdery cosmetic material which is filled in the arbitrary concave portions performs an anchoring effect so that the powdery cosmetic material adhering layer is firmly adhered to the sheet substrate. Further, the above-mentioned concave portions have an oblong shape in a plan view and have bottom portions thereof formed into a curved plane of a dish shape so that the powdery cosmetic material which is filled in the above-mentioned arbitrary concave portions can be easily taken out by adhering the powdery cosmetic material to a powder puff or the like whereby a substantially total amount of the powdery cosmetic material which constitutes the powdery cosmetic material adhering layer can be used.

According to the present invention, when a plate-like frame which has a height thereof higher than a height of the above-mentioned powdery cosmetic material adhering layer is laminated on the upper surface of the above-mentioned sheet substrate and a protective cover is releaseably adhered to an upper surface of the plate-like frame, there is no possibility that an upper surface of the above-mentioned powdery cosmetic material adhering layer comes into contact with a lower surface of the protective cover so that even when the protective cover is peeled off in the trial use of the cosmetic material sheet, the powdery cosmetic material is hardly adhered to the lower surface of the protective cover.

Then, a method for manufacturing a cosmetic material sheet includes a step for supplying a mount which has a large number of concave portions formed on an upper surface thereof wherein each concave portion has an oblong shape in a plan view and has a bottom portion thereof formed into a curved plane of a dish shape, a step for filling powdery cosmetic material at a given position on the upper surface of the mount supplied in the above-mentioned manner in a state that the powdery cosmetic material covers the arbitrary concave portions among a large number of concave portions, a step for pressing the filled powdery cosmetic material, a step for adhering lamination material to the upper surface of the mount after the mount passes the pressing in a state that the lamination material covers the pressed powdery cosmetic material, and a step for cutting given portions of the mount after the mount passes the adhesion of the lamination material thus obtaining a cut piece as a cosmetic material sheet.

Further, a device for manufacturing a cosmetic material sheet according to the present invention includes a supply device which supplies amount which has a large number of concave portions formed on an upper surface thereof wherein each concave portion has an oblong shape in a plan view and has a bottom portion thereof formed into a curved plane of a dish shape, a filling device which fills powdery cosmetic material at a given position on the upper surface of the mount supplied from the supply device in a state that the powdery cosmetic material covers the arbitrary concave portions among a large number of concave portions, a press device which presses the powdery cosmetic material filled by the filling device, a laminating device which adheres lamination material to the upper surface of the mount after the mount passes the press device in a state that the lamination material covers the pressed powdery cosmetic material, and a cutting device which cuts given portions of the mount after the mount passes the laminating device thus obtaining a cut piece as a cosmetic material sheet.

That is, the method and device for manufacturing a cosmetic material sheet according to the present invention enable the uniform and efficient manufacturing of the cosmetic material sheet which has the above-mentioned excellent effects.

Further, in the method for manufacturing a cosmetic material sheet according to the present invention, when the mount is formed of a strip-like mount and the method includes a step which winds or takes up the-strip-like mount after cutting the cosmetic material sheets, the cosmetic material sheets can be continuously manufactured. Other features and advantages of the invention will be appeared from the following detailed description taken in conjunction with the accompanying drawings that illustrate, by way of example, various features of embodiments of the invention.

PREFERRED EMBODIMENTS OF THE PRESENT INVENTION

Subsequently, the present invention is explained in detail.

According to one embodiment, a cosmetic material sheet of the present invention includes a sheet substrate on which a large number of concave portions are formed, a powdery cosmetic material adhering layer and a protective cover.

Various kinds of resin sheets including PP (polypropylene) resin sheets or the like and various paper sheets including woodfree paper or the like can be used as the sheet substrate. The thickness of the PP resin sheet is set to 6 to 400 $\mu$m, and more particularly, to 100 to 200 $\mu$m.

On the other hand, woodfree paper or paperboard is set to 80 to 500 g/m$^2$, and more particularly to 180 to 310 g/m$^2$.

Figure 20:
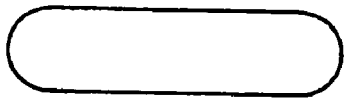
FIG. 20, FIG. 21, FIG. 22 and FIG. 23 are views showing modifications of the concave portions.
Figure 21:
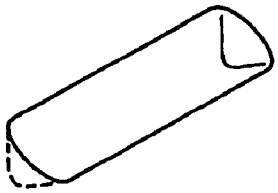
Figure 22:
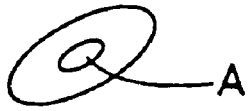
Figure 23:
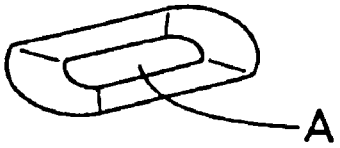

To take out a substantially amount of powdery cosmetic material adhered to the inside of the concave portions, each concave portion is required to have an oblong shape in a plan view and to have a bottom portion thereof formed into a curved plane of a dish shape. In the present invention, "oblong" means not only "elliptical" but also an "elongated shape" as shown in FIG. 20. Further, "curved plane of a dish shape" means not only a shape of an earthen mortar or the like but also a curved shape having an acute angle as shown in FIG. 21 and a shape having a flat bottom surface as shown in FIG. 22 and FIG. 23 (a flat surface being indicated by A in FIG. 22 as well as in FIG. 23). As a method for forming such concave portions, a method which adopts embossing (flat-pressure press forming or circular-pressure press forming) or a method which adopts screen printing, photogravure printing or offset printing or the like can be used. Further, as a pattern for arranging a large number of such concave portions on the upper surface of the sheet substrate, various patterns including a checkered pattern, a staggered pattern, a radial pattern, a vortex pattern or the like or a combination of these patterns can be considered.

Further, the depth of the concave portions is set within a range of 1 to 500 μm, and more particularly within a range of 1 to 300 μm. Further, the lateral width of the concave portions is set within a range of 50 to 2000 μm, and more particularly within a range of 50 to 1000 μm.

Further, a longitudinal width of the concave portions is set within a range of 50 to 2000 μm, and more particularly within a range of 50 to 1000 μm. Then, when the depth of the concave portions is set to 1 to 500 μm, the lateral width is set to 50 to 2000 μm and the longitudinal width is set to 50 to 2000 μm with respect to the concave portions, a substantially total amount of powdery cosmetic material can be taken out without leaving the powdery cosmetic material in the inside of the concave portions. Particularly, when the depth of the concave portions is set to 1 to 300 μm, the lateral width is set to 50 to 1000 μm and the longitudinal width is set to 50 to 1000 μm with respect to the concave portions, a total amount of powdery cosmetic material can be removed easily. Further, since the shape of the concave portions can be made small, the number of concave portions which can be formed on the upper surface of the sheet substrate can be increased so that the removal preventive property derived from the anchoring effect can be increased. Further, when the shape of the above-mentioned concave portions is formed in an elliptical shape, the lateral width indicates a length of a long axis and the longitudinal width indicates a length of a short axis.

As a method which forms the powdery cosmetic material adhering layer on the sheet substrate, it is preferable to use a method in which the powdery cosmetic material mounted on a mesh of a printing plate is scrubbed down through the mesh and is applied to a desired position on the sheet substrate using a brush and thereafter the powdery cosmetic material is pressed Since the method uses the brush, bristles do not collapse the powdery cosmetic material and hence, the quality of the powdery cosmetic material is not deteriorated.

As the protective cover, lamination material or the like which is cut in a given shape by a cutting device of a manufacturing device which will be explained later can be used. A transparent or a semi-transparent protective cover such as a PET film or the like can be used. The thickness of the PET film is set to 6 to 180 μm, and more particularly to 25 to 75 μm.

It may be desirable to insert a plate-like frame between the sheet substrate and the protective cover. As the plate-like frame, a PET film, a woodfree paper or the like can be used. A thickness of the PET film is set to 6 to 300 μm, and more particularly to 50 to 150 μm. On the other hand, the woodfree paper or the paperboard is set to 80 to 450 g/m$^2$, and more particularly to 180 to 260 g/m$^2$.

As an adhesive agent which is used for laminating the sheet substrate, the plate-like frame and the protective cover, a room-temperature curing-type adhesive agent, a thermosetting-type adhesive agent, a hot-melt-type adhesive agent, a pressure-sensitive-type adhesive agent or the like can be used.

Further, as an adhesive agent which is used for laminating the protective cover to the sheet substrate, a re-peeling type adhesive agent (an adhesive agent of a type which performs an adhesion again after peeling) or a weak-adhesion adhesive agent (an adhesive agent which makes the re-adhesion after peeling difficult).

Figure 1:
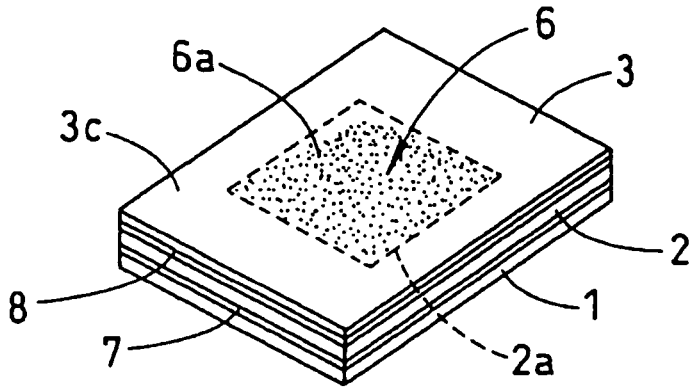
FIG. 1 is a perspective view showing one embodiment of a cosmetic material sheet of the present invention.
Figure 2:
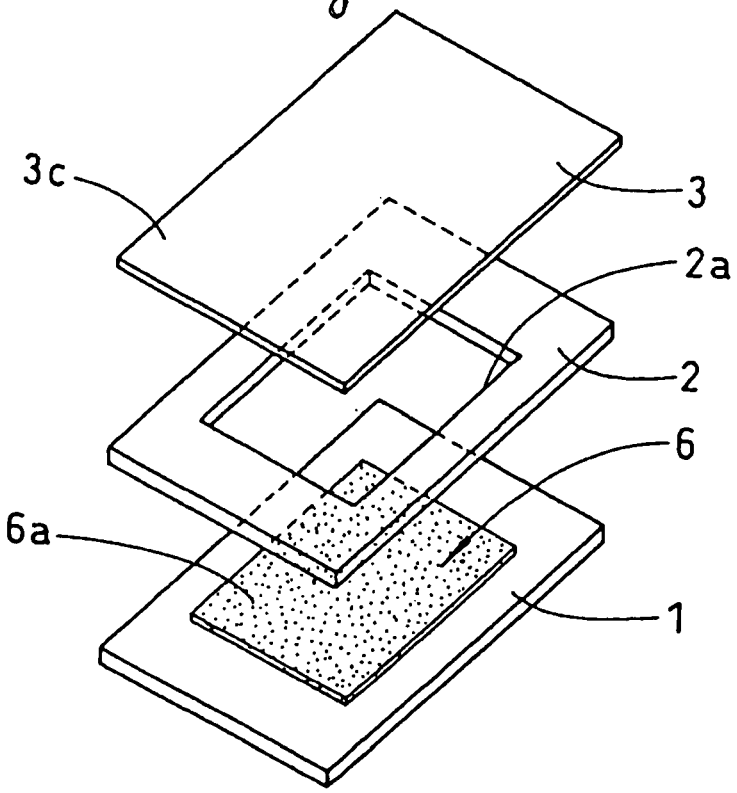
FIG. 2 is an exploded perspective view of the cosmetic material sheet.
Figure 3:
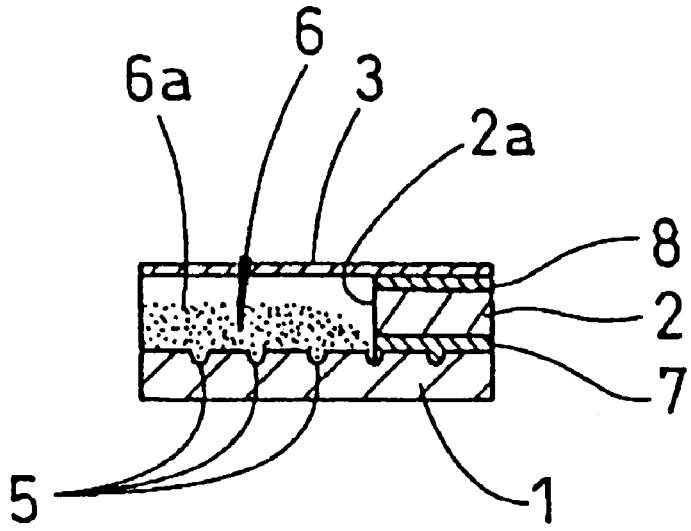
FIG. 3 is a cross-sectional view of an essential part of the cosmetic material sheet.
Figure 4:
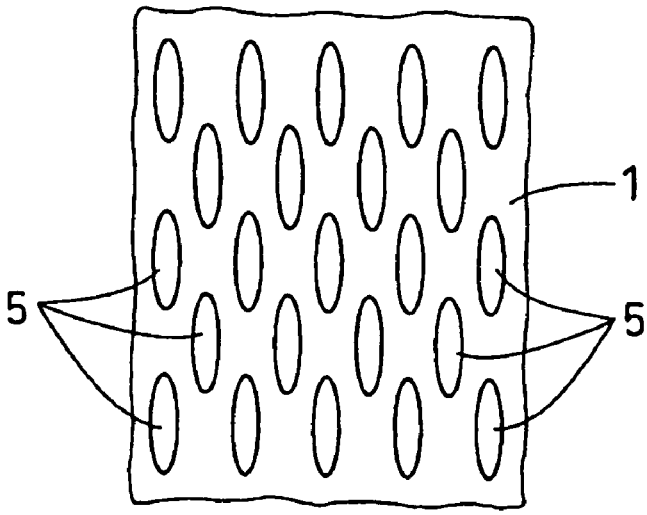
FIG. 4 is an explanatory view of concave portions of the cosmetic material sheet.
Figure 5:
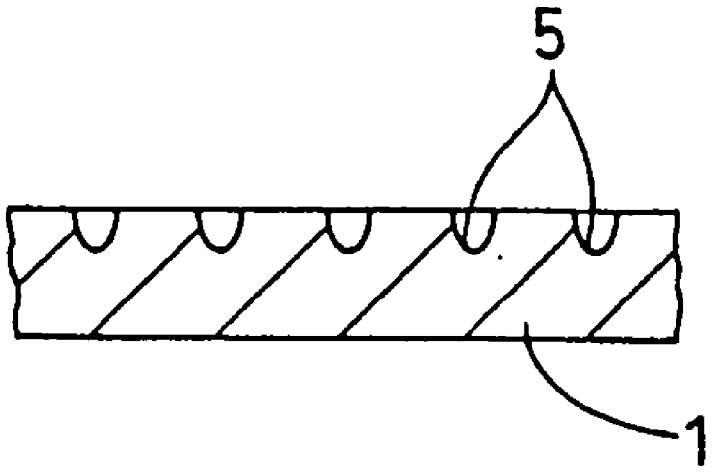
FIG. 5 is a transverse cross-sectional view of the concave portions.
Figure 6:
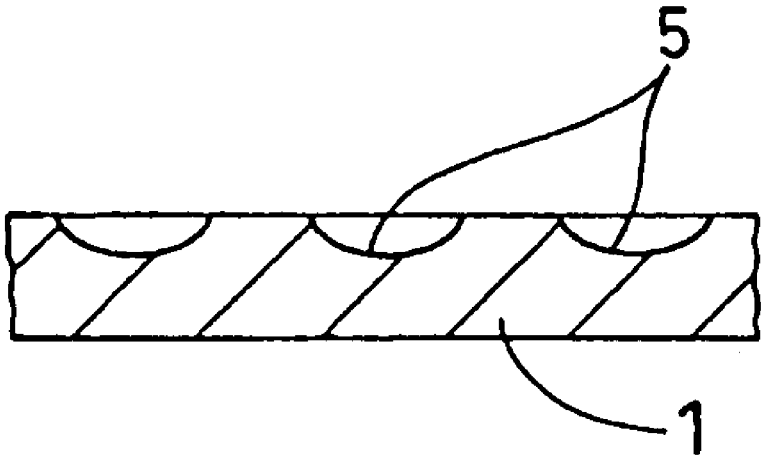
FIG. 6 is a longitudinal cross-sectional view of the concave portions.

FIG. 1 shows one embodiment of a cosmetic material sheet of the present invention. In this embodiment, the cosmetic material sheet includes a sheet substrate 1, a plate-like frame 2 and a protective cover 3. The sheet substrate 1 is formed of a milky-white PP resin sheet having a thickness of 100 μm and a large number of concave portions 5 (see FIG. 3) are formed on the entire surface of the upper surface in a checkered pattern (see FIG. 4). In this embodiment, as shown in FIG. 4, the concave portions 5 are arranged not only in the checkered pattern but also in a state that a group consisting of five rows of the concave portions 5 disposed close to each other are arranged in a staggered pattern in two stages, that is, upper and lower stages, wherein the group consisting of five rows of the concave portions 5 in the upper stage enter the group consisting of five rows of the concave portions 5 in the lower stage. These respective concave portions 5 (depth: 60 μm) are formed by embossing and have an elliptical shape (the length of the long axis: 100 μm, the length of the short axis: 30 μm) in a plan view as shown in FIG. 4 and have bottom surfaces thereof formed into a curved plane of a mortar shape (or a dish shape) as shown in FIG. 5 and FIG. 6.

Numeral 6 indicates a foundation layer (powdery cosmetic material adhering layer) which is formed on the upper surface of the sheet substrate 1 in a given shape (a quadrangular shape in this embodiment). A powdery foundation material 6*a,* which is a cosmetic material actually produced for sale is different from a sample cosmetic material.

The above-mentioned plate-like frame 2 is composed of a milky-white PET resin sheet (not shown in the drawing) having a thickness of 188 μm and an aluminum vapor-deposition layer having a thickness of 50 μm (not shown in the drawing) which is formed on the upper surface of the resin sheet. The plate-like frame 2 is laminated to the upper surface of the above-mentioned sheet substrate 1 by way of a strong-adhesive agent layer 7. In the plate-like frame 2, at a portion which corresponds to the foundation layer 6, a window portion 2*a* is formed such that the plate-like frame 2 surrounds the foundation layer 6. Further, a height of the plate-like frame 2 is set higher than a height of the foundation layer 6 such that a gap is formed between the foundation layer 6 and the protective cover 3.

Further, the above-mentioned aluminum vapor-deposition layer is formed by vapor-depositing aluminum on an upper surface of the PET resin sheet in a usual manner. On the entire or a portion of the upper surface of the aluminum vapor-deposition layer, a product number, a color number or the like is printed by silk printing or photogravure printing or the like or a name of a cosmetic maker, a catch phrase, a trade mark, a product number, a retailer indication, a design, a ground pattern, other information or the like is indicated.

The above-mentioned window portion 2*a* is formed as an opening such that the window portion 2*a* is approximately equal to or slightly smaller than the foundation layer 6 in size. However, when the window portion 2*a* is formed such that it is slightly smaller than the foundation layer 6 in size, even when the foundation layer 6 is formed such that it is made slightly larger than a given size or is slightly displaced from an outer line, the window portion 2*a* plays a role of a mask when the protective cover 3 is laminated on the upper surface of the sheet substrate 1 so that an advantageous effect that the foundation layer 6 appears to be formed at a given position through the window portion 2*a* is obtained.

The shape of the window portion 2*a* is configured in an arbitrary shape such as a rectangular shape, a circular shape, an elliptical shape, a heart shape, a lip shake, a lip stick shape or the like.

The protective cover 3 is formed of a transparent PET resin sheet having a thickness of 75 μm. Due to a weak adhesive agent layer 8 which is coated and formed on a portion of a lower surface of the protective cover 3 which corresponds to the upper surface (that is, the entire surface of the aluminum vapor-deposited layer) of the plate-like frame 2 except for one corner portion (front left corner portion in the drawing) 3*c,* the protective cover 3 is releaseably adhered to the upper surface of the plate-like frame 2.

Then, since the height of the plate-like frame 2 is set higher than the height of the foundation layer 6 in a state that protective cover 3 is adhered to the upper surface of the plate-like frame 2, the lower surface of the protective cover 3 is not brought into contact with the upper surface of the foundation layer 6. Further, since the weak adhesive agent layer 8 is not coated or formed on one corner portion 3*c* of the lower surface, the protective cover 3 can be easily peeled from the above-mentioned one corner portion 3*c*.

Figure 7:
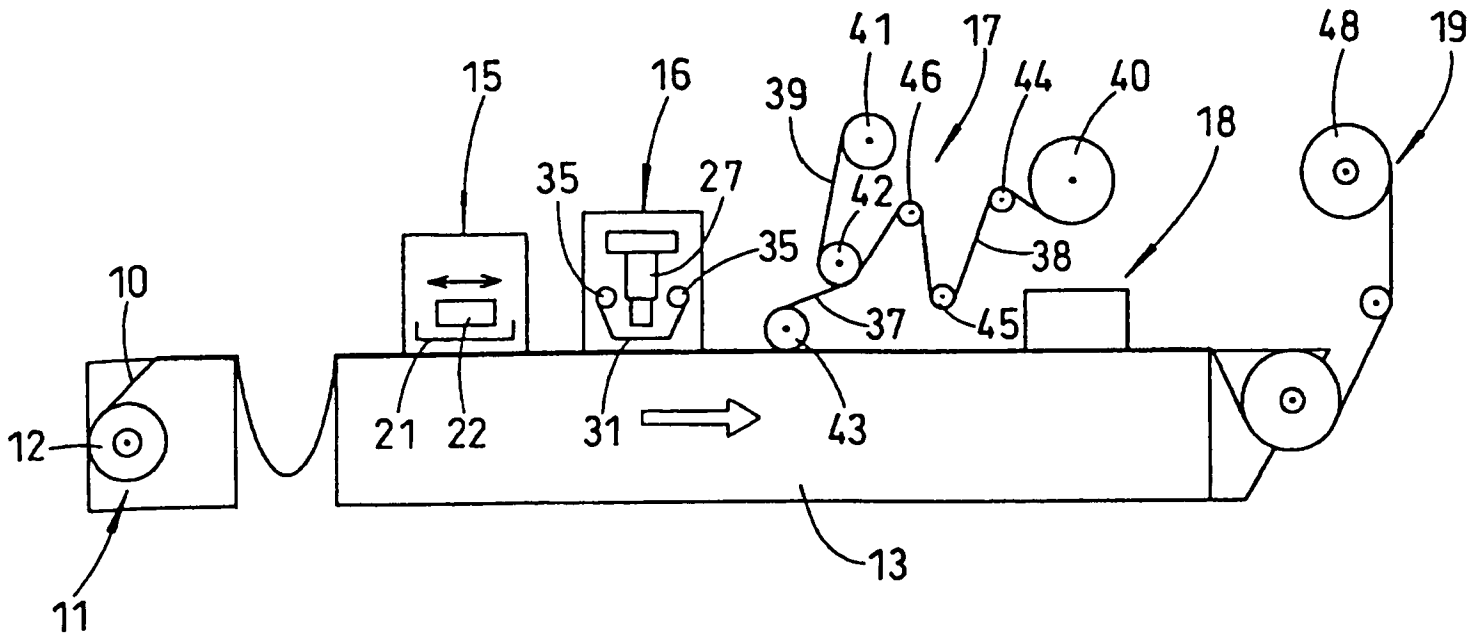
FIG. 7 is an explanatory view showing one embodiment of a device for manufacturing a cosmetic material sheet according to the present invention.

The above-mentioned cosmetic material sheet can be manufactured by using a manufacturing device shown in FIG. 7. In the drawing, numeral 11 indicates a supply device which is arranged at one end portion (left end portion in the drawing) of the manufacturing device. A roller 12 around which a mount 10 is wound is rotatably supported on the supply device 11. Further, a distal end of the mount 10 is pulled out toward the other end side such that the distal end is wound around a roller 48 of the winding device 19 which will be explained later and is arranged at the other end portion (a right end portion in the drawing) of the manufacturing device. The roller 12 of the supply device 11 and the roller 48 of the winding device 19 are designed to be controlled such that they are synchronously and intermittently driven. Further, a pair of front and rear rollers (not shown in the drawing) are arranged between the supply device 11 and a base 13 which will be explained later so as to make the mount 10 always droop between a pair of rollers. Due to such a constitution, the mount 10 can have an excess in length between both rollers so that the mount 10 can be smoothly moved from one end side to the other end side of the manufacturing device.

The mount 10 (made of the sheet substrate 1 in the embodiment shown in FIG. 1) is formed of a milky-white PP resin sheet having a thickness of 100 $\mu$m and a large number of concave portions 5 (see FIG. 4 to FIG. 6) on the entire surface of the mount 10 in a checkered pattern. Further, on a rear surface of the mount 10, a printing such as the responsibility indication or the like (not shown in the drawing) is performed at a given interval in the longitudinal direction.

On an upper portion of the base 13, a filling device 15, a press device 16, a lamination-device 17, a cutter device 18 and a winding device 19 are mounted.

Figure 8:
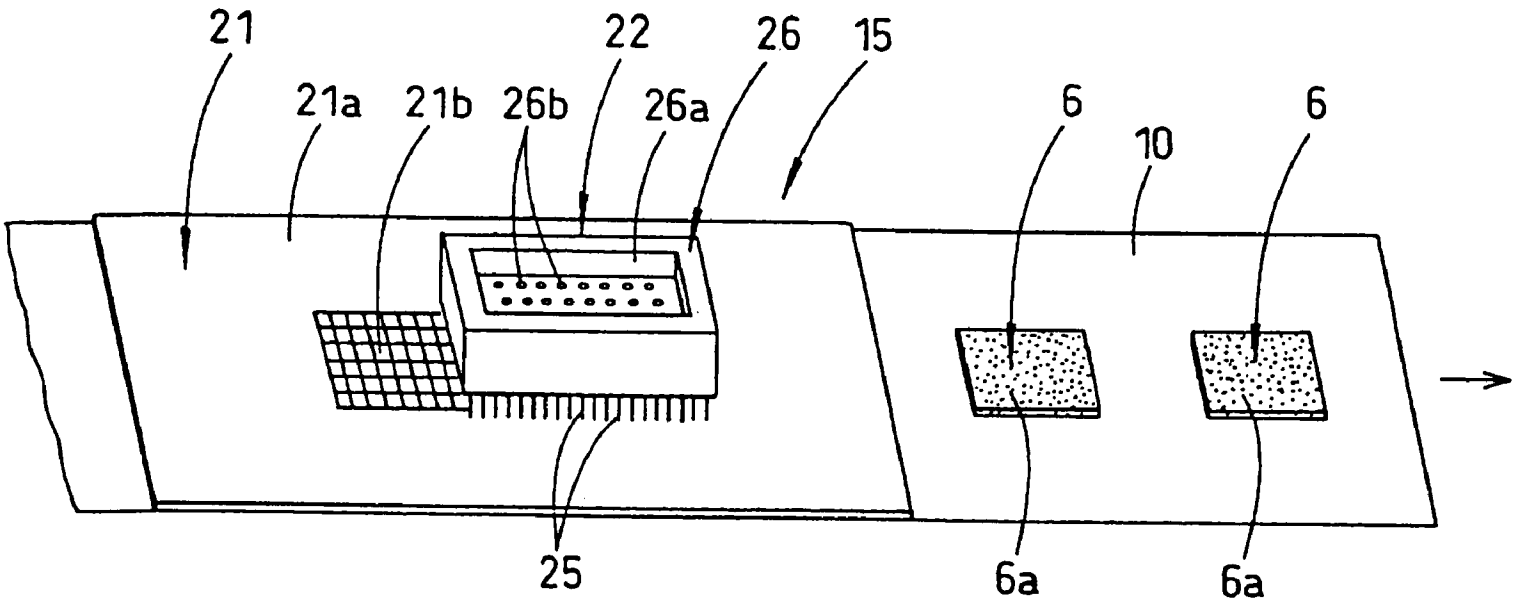
FIG. 8 is an explanatory view of a filling device of the manufacturing device.

The filling device 15, as shown in FIG. 8, includes a printing plate 21, a brush 22, powdery cosmetic material supply means (not shown in the drawing), printing plate moving means (not shown in the drawing) which moves the printing plate 21 in the upward and downward directions, and brush moving means (not shown in the drawing).

The printing plate 21 includes a rectangular sheet body 21*a* made of polypropylene (thickness: 0.5 mm) and a mesh 21*b* made of silk GG16 (thickness: 0.5 mm) formed at a given position of the rectangular sheet body 21*a*. The mesh 21*b* is formed in a shape corresponding to the shape of foundation layer 6 of the cosmetic material sheet.

The brush 22 is constituted of a large number of bristles 25 made of nylon or polyethylene (diameter at proximal portions: 0.2 mm $\phi$, total length: 60 mm) having distal end thereof tapered, and a bristle holding portion 26 which holds a large number of bristles 25 on a lower surface thereof such that bristles 25 are extended downwardly. On an upper surface of the bristle holding portion 26, a recessed portion 26*a* which accommodates powdery foundation material 6*a* is formed. The powdery foundation material 6*a* which is actually used as a product (cosmetic material actually used) is supplied to and filled in the recessed portion 26*a* from the powdery cosmetic supply means. Further, in a bottom surface of the recessed portion 26*a,* a plurality of through holes 26*b* (hole diameter: 3 mm $\phi$) which are extended linearly to the lower surface of the bristle holding portion 26 (to be more specific, portions of the lower surface between respective bristles 25) are formed so that the powdery foundation material 6*a* can be uniformly supplied onto the mesh 21*b* of the printing plate 21.

The brush moving means finely moves the brush 22 in the upward and downward directions (vibrates the brush 22 with an amplitude of 1 mm) and performs one reciprocation (pitch: 1 second, 10 cm/stroke) in the leftward and rightward direction (that is, in the advancing direction of the mount 10).

Figure 9:
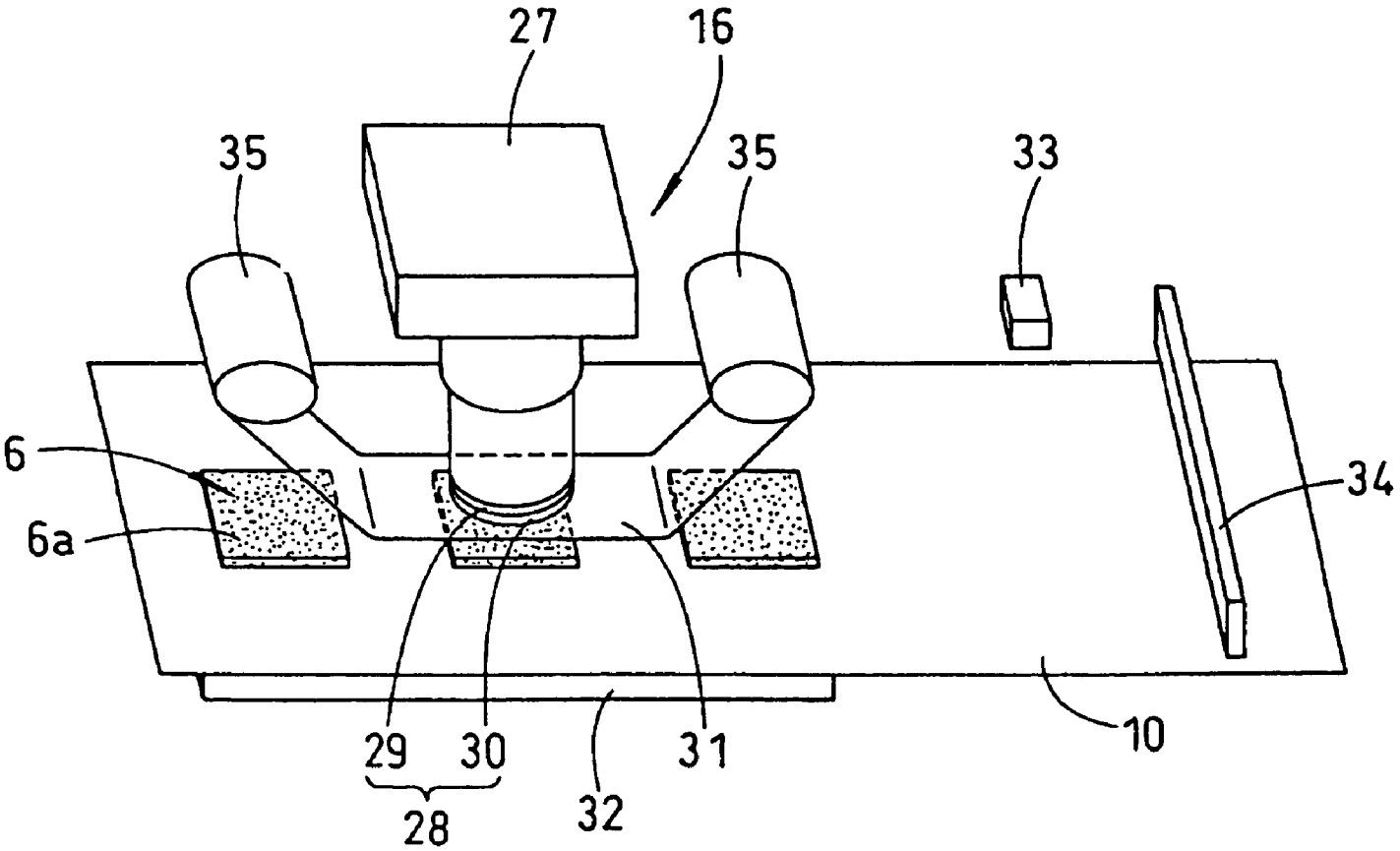
FIG. 9 and FIG. 10 are explanatory views of a press device.
Figure 10:
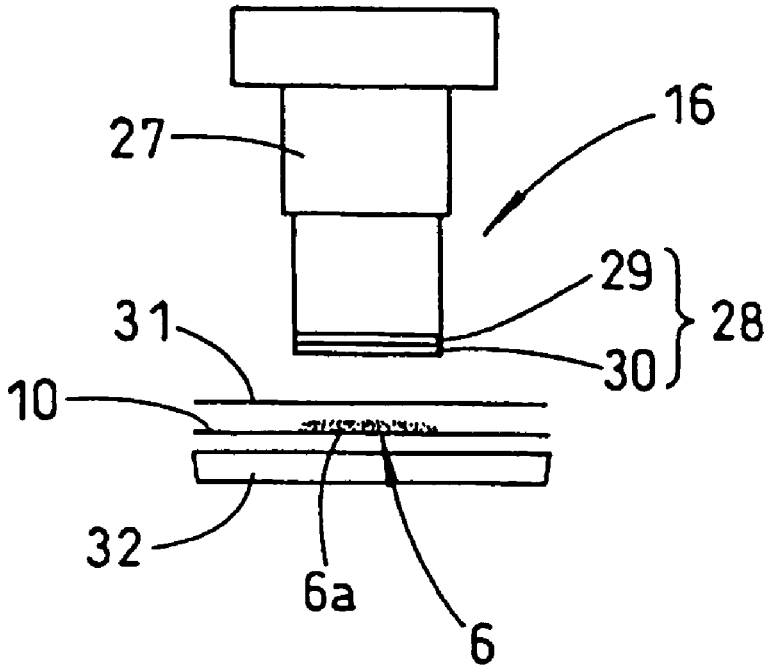

The press device 16 includes, as shown in FIG. 9 and FIG. 10, a press portion 27 of a pneumatic cylinder type (pressure: 0.3 kgf/cm$^2$, time: 0.5 to 1.0 sec), a shock absorbing member 28 (made of an upper-side shock absorbing urethane rubber layer 29 and a lower-side foamed urethane layer 30) which is mounted on a lower surface of the press portion 27, a mesh 31 (material: silk) of XX7 which is disposed between the shock absorbing member 28 and the mount 10, a shock absorbing urethane rubber plate 32 having a flat plate shape which is disposed below the mount 10, drive means (not shown in the drawings) which drives the press portion 27 in the upward and downward directions, a dust collecting device 33 which sucks powdery material adhered to the mesh 31, a dust collecting device 34 which sucks powdery material adhered to the mount 10, and a pair of rollers 35 which are served for winding the mesh 31 each time the pressing is performed. Both of these rollers 35 are rotatable in a reverse manner. The mesh 31 is wound from one roller 35 to the other roller 35 and when the mesh 31 is totally paid off from one roller 35, these rollers are rotated in the reverse direction so that mesh 31 is wound from the other roller 35 to one roller 35 so that they can be used semi-permanently.

Using these filling device 15 and press device 16, a given portion on the upper surface of the mount 10 is coated with the powdery foundation material 6*a* in the following manner.

Figure 11:
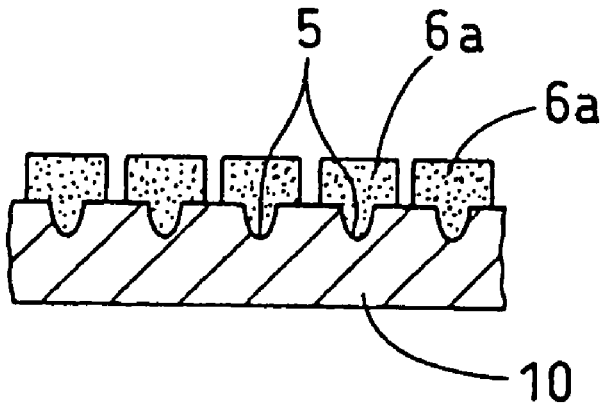
FIG. 11 and FIG. 12 are explanatory views of a method for manufacturing a cosmetic material sheet according to the present invention.

That is, first of all, upon completion of the preceding filling operation, the printing plate 21 is disposed at a position spaced apart from the mount 10. Subsequently, due to the intermittent driving of the roller 12 of the supply device 11 and the roller 48 of the winding device 19, a silk printing expected portion of the mount 10 is moved to the lower side of the printing plate 21. Then, the printing plate 21 is descended upon driving of the printing plate moving means so that the mesh 21*b* of the printing plate 21 is positioned above the silk printing expected portion of the mount 10 with a given gap between them. Subsequently, the brush 22 is finely moved in the upward and downward directions upon driving of the brush moving means in one reciprocation in the leftward and rightward directions. Then, within one reciprocation, the powdery foundation material 6*a* which is accommodated in the recessed portion 26*a* of the brush 22 is made to flow down through a large number of through holes 26*b* and to fall on the mesh 21*b*. Subsequently, the powdery foundation material 6*a* is pushed into openings of the mesh by the bristles 25 and is adhered to the upper surface of the mount 10 (see FIG. 11). Here, since the brush 22 is finely moved in the upward and downward directions, the mesh 21*b* which comes into contact with the bristles 25 also finely moves and hence, the powdery foundation material 6*a* can easily fall from the apertures of the mesh 21*b* so that the powdery foundation material 6*a* is not collapsed.

Figure 12:
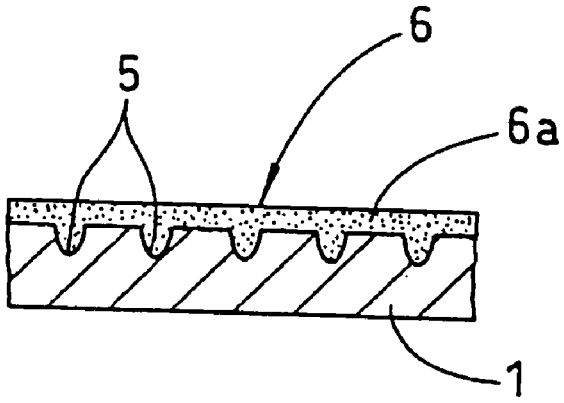

Then, in the press device 16, upon completion of the preceding pressing operation, the press portion 27, the mesh 31 and the urethane rubber plate 32 are at positions spaced apart from the mount 10 (see FIG. 10). Subsequently, due to the above-mentioned intermittent movement, a pressing expected portion (a portion where the powdery foundation material 6*a* is filled by the filling device 15) of the mount 10 is fed to the lower side of the pressing portion 27. Then, the pressing portion 27 is descended upon actuation of the drive means so as to press the portion where the above-mentioned powdery foundation material 6*a* is filled. As a result, the foundation layer 6 (see FIG. 12) is formed on the upper surface of the mount 10.

The lamination device 17 is a device provided for adhering lamination material 37 to the upper surface of the mount 10. The above-mentioned lamination material 37 is includes a transparent PET resin sheet (eventually forming the protective cover 3 in the embodiment shown in FIG. 1) having a thickness of 75 $\mu$m, a weak adhesive agent layer which is formed on a rear surface of the resin sheet, a frame (eventually forming the plate-like frame 2 in the embodiment shown in FIG. 1) which is adhered to the weak adhesive agent layer and has a window portion 2*a* formed therein at a portion corresponding to the foundation layer 6 on the upper surface of the mount 10, and a strong adhesive agent layer formed on a rear surface of the frame. In FIG. 7, the resin sheet, the weak adhesive agent layer, the frame and the strong adhesive agent layer are not shown in the drawing.

The lamination device 17 includes, as shown in FIG. 7, a roller 40 around which a lamination member 38 (member which is constituted by releaseably adhering a peel-off member 39 which is formed by subjecting the surface of the PET film to the mold release treatment using silicone or the like on the strong adhesive agent layer formed on the rear surface of the lamination material 37) is wound, a roller 41 which winds the peel-off member 39 of the lamination member 38, and a roller 43 which the lamination material 37 of the lamination member 38 passes. The lamination member 38 which is wound around the roller 40 is pulled out toward the other end side such that the distal end of the lamination member 38 is wound around the roller 48 of the winding device 19. In the midst of the winding operation, after the lamination member 38 passes the roller 42, the peel-off member 39, of the lamination member 38 is wound around the roller 41. On the other hand, in a state that the lamination material 37 of the lamination member 38 passes the roller 43, the lamination material 37 is adhered with pressure to the upper surface of the mount 10 on the outer peripheral surface of the roller 43. In FIG. 7, numeral 44 to 46 are provided for transporting the lamination member 38.

The above-mentioned cutting device 18 cuts the mount 10 which has passed the lamination device 17 so as to produce the cosmetic material sheet shown in FIG. 1. Further, with respect to the mount 10, the portion remaining after cutting the mount 10 with the cutting device 18 is wound around the roller 48 of the winding device 19.

In this manner, in the above-mentioned embodiment, the cosmetic material sheets can be manufactured continuously. Further, by using cosmetic material actually used (cosmetic material having the same quality as that of powdery cosmetics manufactured for sale) which is not a sample cosmetic material as the powdery foundation material 6*a*, different from a conventional product which uses the sample cosmetic material which is obtained by dissolving cosmetic material actually used in a solvent or the like, it becomes possible to offer the solid cosmetic material having the same color, gloss and touch as those of the cosmetic material actually used. Accordingly, by actually trying out the cosmetic material made of the solid cosmetic material, a consumer can accurately judge whether the solid cosmetic material which the consumer is going to purchase has quality and hue that the consumer desires so that the cosmetic material sheet is greatly useful for promoting the sale of the solid cosmetic material. Such a cosmetic material sheet may be used either a sample sheet or as a sheet for product.

Further, since there exists a gap between the upper surface of the foundation layer 6 and the lower surface of the protective cover 3, when the protective cover 3 is peeled off, the powdery foundation material 6*a* of the foundation layer 6 is not adhered to the lower surface of the protective cover 3. Further, it becomes possible to protect the foundation layer 6 by shielding the foundation layer 6 from the outside by the protective cover 3 and, at the same time, the appearance of the whole cosmetic material sheet can be improved thus enhancing the value of the cosmetic material sheet as a product. Still further, since the cosmetic material sheet is thin, it can be propagated in a state that it is filed in a filing portion of a weekly magazine, or in a state that it is used as an advertisement guide printed matter such as a direct mail, a post card, a letter, a catalogue, a pamphlet or in a form that it is attached to the advertisement guide printed matter.

Figure 13:
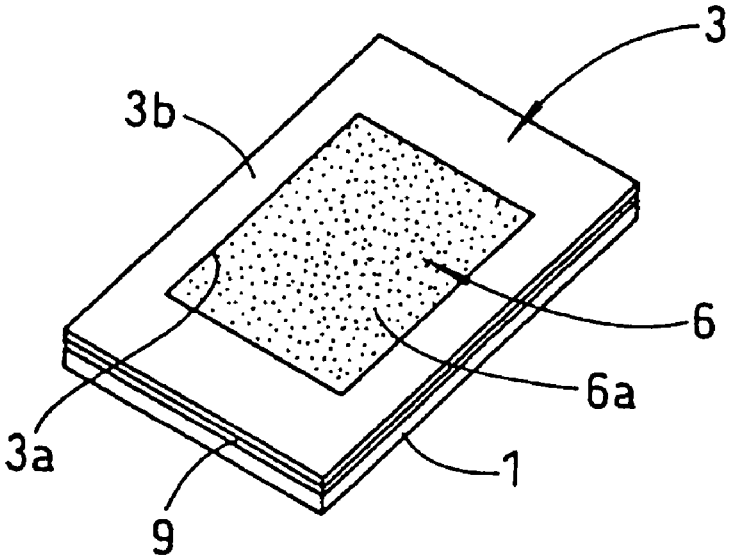
FIG. 13 is a perspective view showing another embodiment of the cosmetic material sheet of the present invention.
Figure 14:
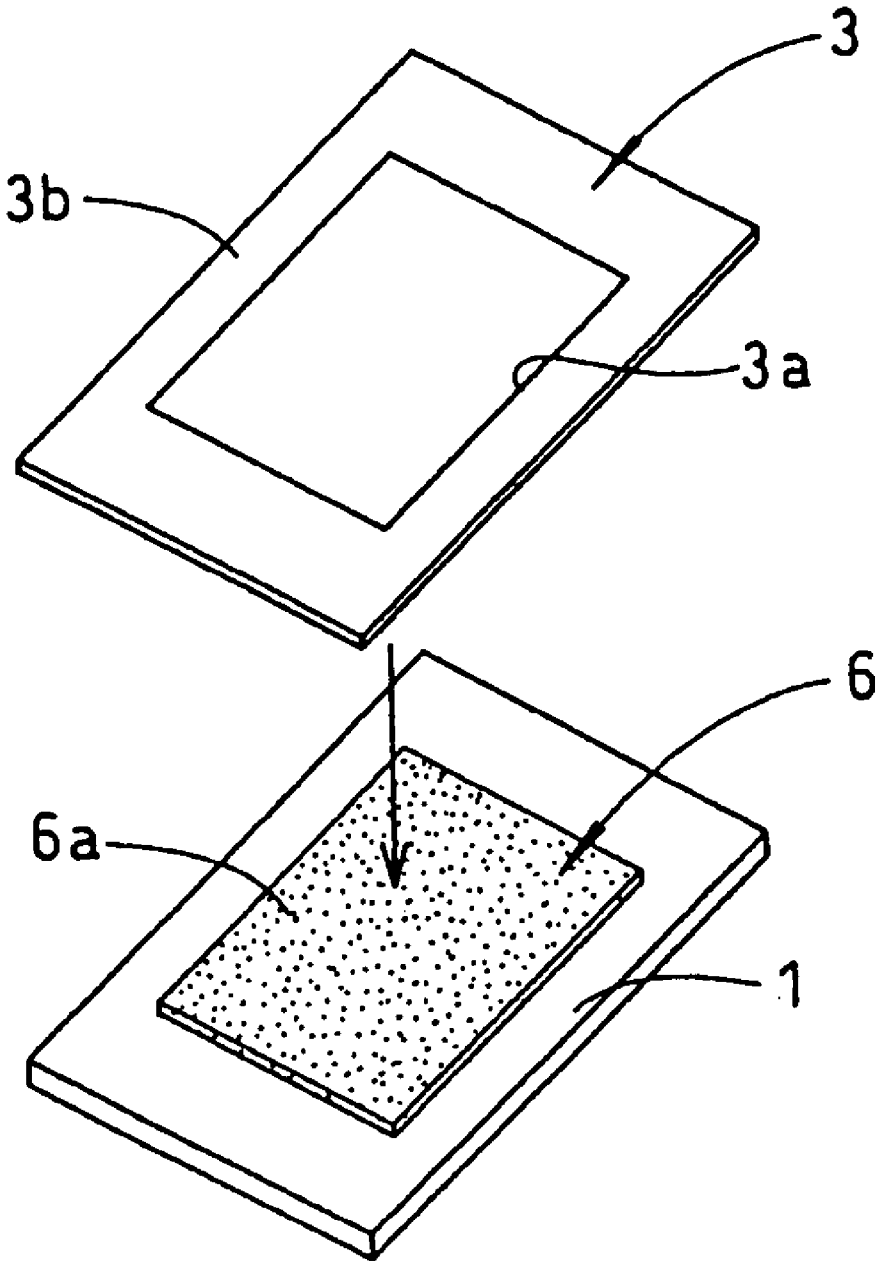
FIG. 14 is an exploded perspective view of the cosmetic material sheet.

FIG. 13 and FIG. 14 show the another embodiment of the cosmetic material sheet according to the present invention.

In this embodiment, the plate-like frame 2 of the embodiment shown in FIG. 1 is not provided. Accordingly, in this embodiment, a protective cover 3 is directly adhered to an upper surface of a sheet substrate 1 by way of an adhesive agent layer 9. Further, the protective cover 3 includes a quadrangular transparent window portion 3*a* which is formed in the center of the protective cover 3 and a printing frame portion 3*b* having a quadrangular frame shape which is formed around the transparent window portion 3*a*. With respect to this printing frame portion 3*b*, on a portion of a rear surface thereof except for one corner portion 3*c* (front left corner portion in the drawing), the adhesive agent layer 9 is formed and the protective cover 3 is releaseably adhered to the upper surface of the sheet substrate 1 by way of this adhesive agent layer 9, Further, on a portion or on the entire surface of both surfaces of the printing frame portion 3*b*, a product number, a color number or the like is printed by silk printing or photogravure printing or the like or a name of a cosmetic maker, a catch phrase, a trade mark, a product number, a retailer indication, a design, a ground pattern or other information or the like is indicated. Other parts of this embodiment are identical with those of the above-mentioned embodiment and hence, identical parts are indicated by the same numerals. This embodiment can also achieve the same manner of operation and the same advantageous effects as the above-mentioned embodiment. However, in this embodiment, since the cosmetic material sheet is not provided with the plate-like frame 2, the upper surface of the foundation layer 6 and the lower surface of the protective cover 3 are brought into contact with each other.

Further, in this embodiment, at the time of manufacturing the cosmetic material sheet, the lamination material 37 which is used in the lamination device 17 does not use the frame body. That is, the lamination material 37 includes a transparent PET resin sheet having a thickness of 75 $\mu$m (eventually becoming the protective cover 3 in the embodiment shown in FIG. 13) and an adhesive agent layer (not shown in the drawing) which is formed on a rear surface of the resin sheet at a given position (portion corresponding to the printing frame portion 3*b* of the protective cover 3 except for one corner portion 3*c*).

Figure 15:
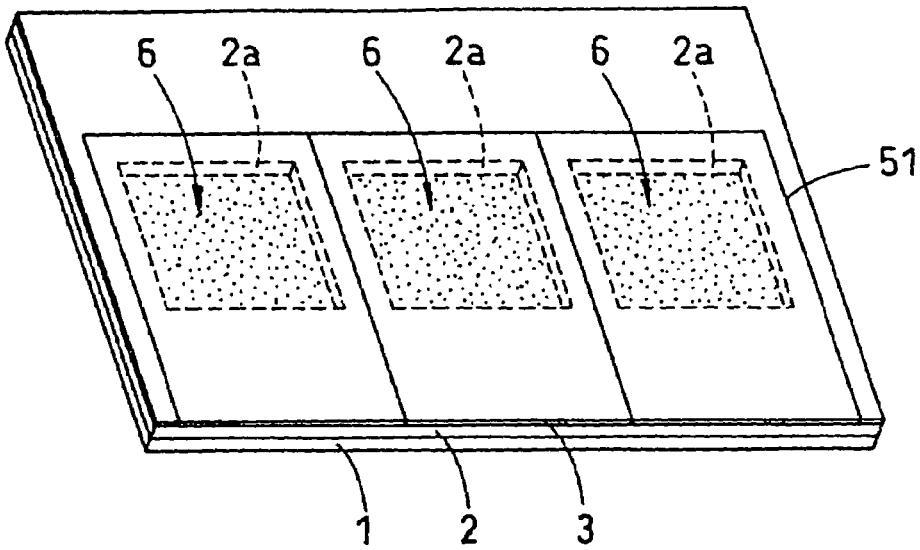
FIG. 15 is a perspective view showing still another embodiment of the cosmetic material sheet of the present invention.
Figure 16:
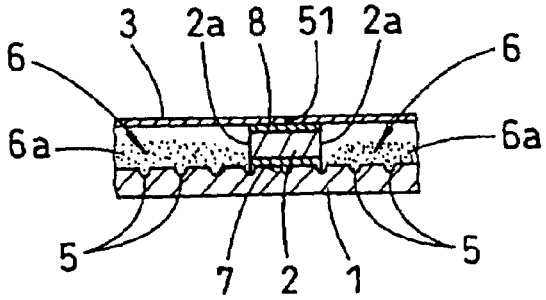
FIG. 16 is a cross-sectional view of an essential part of the cosmetic material sheet.

FIG. 15 and FIG. 16 show still another embodiment of the cosmetic material sheet according to the present invention. In this embodiment, three foundation layers 6 are formed on the upper surface of the sheet substrate 1 of the embodiment shown in FIG. 1 at an approximately equal interval. Further, window portions 2*a* are formed in the plate-like frame 2 at portions thereof corresponding to the respective foundation layers 6. Still further, two U-shaped incisions 51 which are extended from the front end periphery of the protective cover 3 are formed in the protective cover 3 at positions corresponding to the respective window portions 2*a* such that portions which are surrounded by the respective incisions 51 can be separated from the front end periphery of the protective cover 3 by cutting. In FIG. 15, the strong adhesive agent layer 7 and the weak adhesive agent layer 8 are not shown. Other parts of this embodiment are identical with those of the above-mentioned embodiments and hence, identical parts are indicated by the same numerals. This embodiment can also achieve the same manner of operation and the same advantageous effects as the above-mentioned embodiments.

Figure 17:
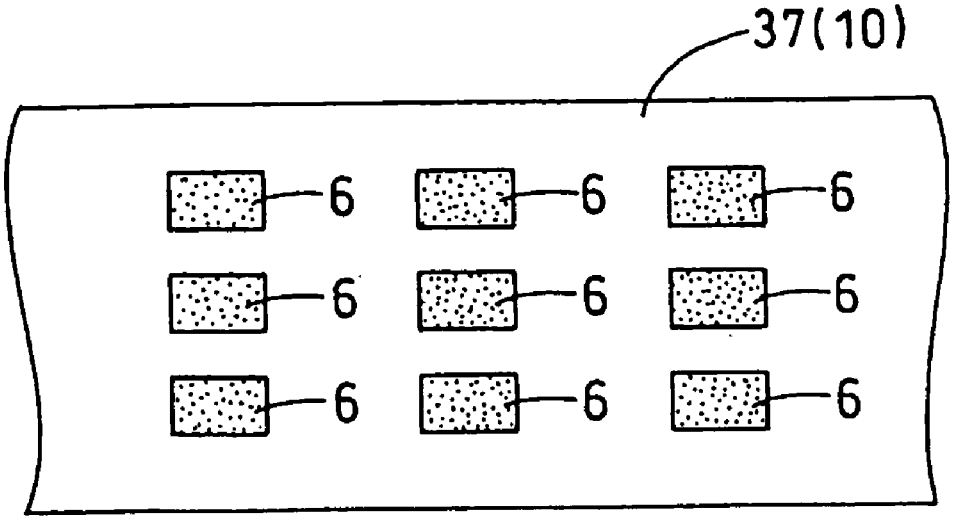
FIG. 17 is an explanatory view of a method for manufacturing the cosmetic material sheet shown in FIG. 15 and FIG. 16.

Such a cosmetic material sheet can be manufactured in the same manner as the embodiment shown in FIG. 1. However, since three foundation layers 6 are formed on the upper surface of the mount 10 (see FIG. 17) in this embodiment, three sets of filling devices 15 shown in FIG. 7 and three sets of press devices 16 shown in FIG. 8 are provided. Here, when the powdery foundation materials 6*a* which are used in respective filling devices 15 are required to be different from each other in color, three colors can be simultaneously formed.

Figure 18:
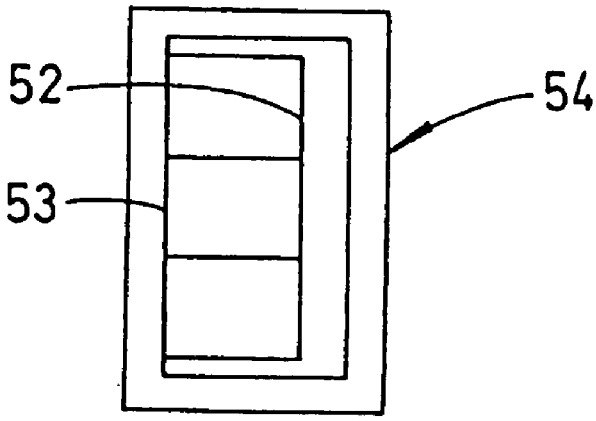
FIG. 18 is an explanatory view of a cutting device in the device for manufacturing a cosmetic material sheet of the present invention and FIG. 19 is an explanatory view showing the manner of operation of the cutting device.
Figure 19:
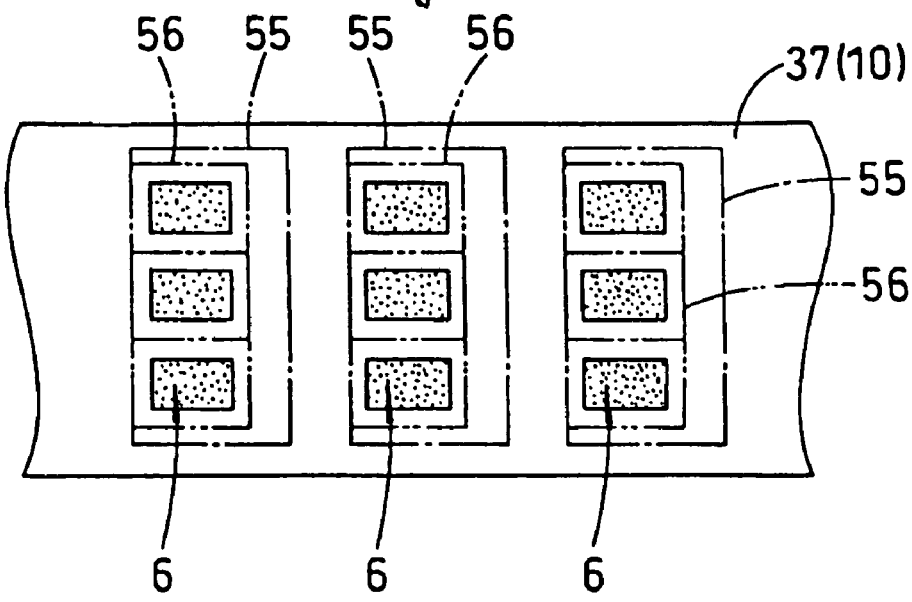

Further, as shown in FIG. 18, the cutting device 18 includes a cutter 54 which includes a full cutting tooth 52 (formed of a rectangular tooth) which cuts both of the mount 10 and the lamination material 37 and a half cut tooth 53 (formed of one long-side tooth and four short-side teeth which are arranged in an equidistant manner within the full cutting tooth 52) which cuts only the protective cover 3. The cutting device 18 cuts the mount 10 which has passed the lamination device 17 as shown in FIG. 19. In FIG. 19, numeral 55 indicates cut lines (indicated by chain lines) formed by the full cutting tooth 52 and numeral 56 indicates half-cut lines (indicated by chain double-dashed lines) formed by the half-cut tooth 53. Respective cut pieces (not shown in the drawing) which are cut in this manner are collected as the cosmetic material sheets in a receiving base (not shown in the drawing). On the other hand, portions of the mount 10 remaining after the cutting operation are wound around the roller 48 of the winding device 19.

Although the cosmetic material sheets are manufactured continuously in the above-mentioned respective embodiments, the cosmetic material sheets may be manufactured one by one. Further, in the above-mentioned respective embodiments, a static eliminator may be provided to prevent dust or the like from adhering to the lamination material 37 or the like. Further, in the above-mentioned respective embodiments, as the sheet substrate 1, a sheet substrate which is formed by coating or laminating a transparent PET resin film having a thickness of 12 $\mu$m onto an upper surface of a woodfree paper (55 kg/m$^2$) having a thickness of 100 $\mu$m may be used. Still further, in the above-mentioned respective embodiments, the mesh 21*b* of the printing plate 21 may be made of nylon, PP resin, PE resin, Tetoron or stainless steel or the like. Further, by processing the mesh 31 of the press device 16, characters such as UV, patterns or the like may be indicated on the surface of the foundation layer 6.

Figure 24:
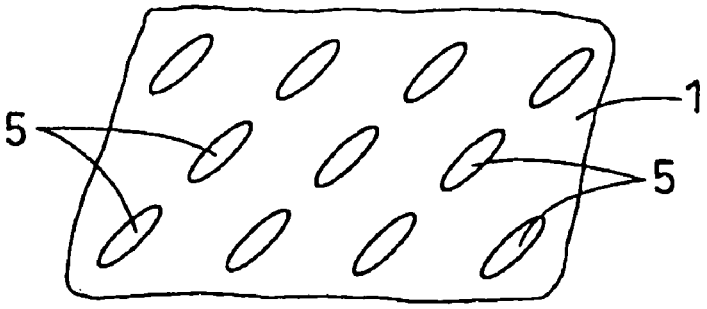
FIG. 24 is a view showing a modification of the state of the arrangement of the concave portions.
Figure 25:
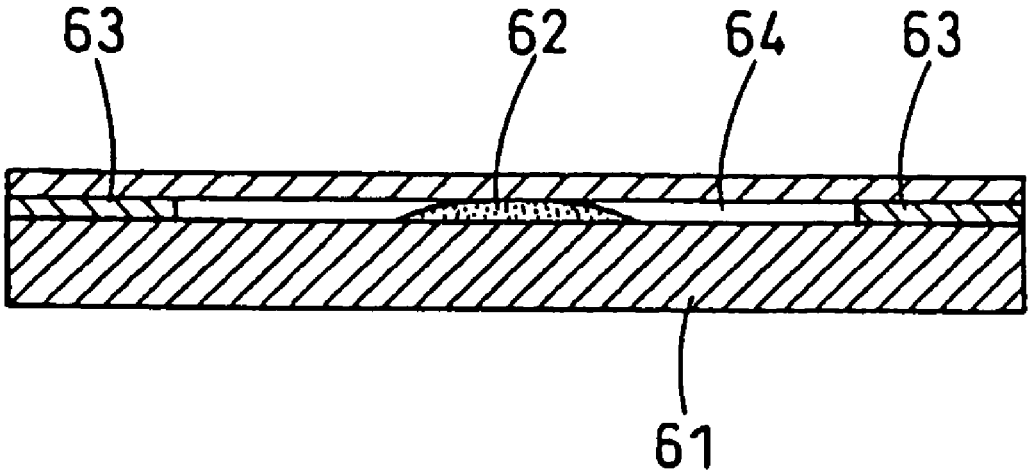
FIG. 25 is a cross-sectional view of a conventional example.

Further, as shown in FIG. 24, a large number of concave portions 5 formed on the whole surface of the upper surface of the sheet substrate 1 may be arranged obliquely such that groups which are respectively made of five rows of neighboring concave portions in upper and lower stages are arranged in a staggered pattern.

As has been described heretofore, according to the cosmetic material sheet of the present invention, by using powdery cosmetic material actually used (powdery cosmetic material having the same quality as that of powdery cosmetic material manufactured for sale) which is not sample cosmetic material as the powdery cosmetic material which constitutes the above-mentioned powdery cosmetic material adhesive layer, different from a conventional product which uses the sample cosmetic material which is obtained by dissolving powdery cosmetic material actually used in a solvent or the like, it becomes possible to offer the powdery cosmetic material totally having the same color, gloss and touch as those of the powdery cosmetic material actually used as a sample. Accordingly, by actually trying out the powdery cosmetic material, a consumer can accurately judge whether the powdery cosmetic material which the consumer is going to purchase has quality and hue which the consumer desires so that the cosmetic material sheet is greatly useful for promoting the sale of the powdery cosmetic material.

Further, the cosmetic material sheet according to the present invention uses the powdery cosmetic material actually used as the powdery cosmetic material of the above-mentioned powdery cosmetic material adhering layer and hence, the cosmetic material sheet can be used as a product. Further, powdery cosmetic material adhering layer is formed in a state that the powdery cosmetic material adhering layer covers arbitrary concave portions out of a large number of concave portions arranged on the upper surface of the sheet substrate and hence, the powdery cosmetic material which constitutes the powdery cosmetic material adhering layer is filled in the above-mentioned arbitrary concave portions. The powdery cosmetic material which is filled in the arbitrary concave portions performs an anchoring effect so that the powdery cosmetic material adhering layer is firmly adhered to the sheet substrate. Further, the above-mentioned concave portions have an oblong shape in a plan view and have bottom portions thereof formed into a curved plane of a dish shape so that the powdery cosmetic material which is filled in the above-mentioned arbitrary concave portions can be easily taken out by adhering the powdery cosmetic material to a powder puff or the like whereby a substantially total amount of the powdery cosmetic material which constitutes the powdery cosmetic material adhering layer can be used.

According to the present invention, when a plate-like frame which has a height thereof higher than that of a height of the above-mentioned powdery cosmetic material adhering layer is laminated on the upper surface of the above-mentioned sheet substrate and a protective cover is releaseably adhered to an upper surface of the plate-like frame, there is no possibility that an upper surface of the above-mentioned powdery cosmetic material adhering layer comes into contact with a lower surface of the protective cover so that even when the protective cover is peeled in the trial use of the cosmetic material sheet, the powdery cosmetic material is hardly adhered to the lower surface of the protective cover.

Further, the method and device for manufacturing a cosmetic material sheet according to the present invention enable the uniform and efficient manufacturing of the cosmetic material which has the above-mentioned excellent effects.

What is claimed is:

1. A method for manufacturing a cosmetic material sheet comprising:

supplying a mount which has a plurality of concave portions formed on an upper surface of the mount, wherein the depth of the concave portions is within a range of 1 to 500 μm, wherein the lateral width of the concave portions is within a range of 50 to 2000 μm, wherein the longitudinal width of the concave portions is within a range of 50 to 2000 μm;

filling powdery cosmetic material on the upper surface of the mount covering the plurality of concave portions;

pressing the filled powdery cosmetic material;

clearing the upper surface of the mount of powdery cosmetic material;

adhering lamination material to the upper surface of the mount, and the pressed powdery cosmetic material forming a powdery cosmetic material adhering layer, wherein the lamination material is releasably adherent, wherein the lamination material comprises a window portion that is smaller than the powdery cosmetic material adhering layer; and cutting the mount on a non-window portion of lamination material to obtain a cut piece as a cosmetic material sheet.

2. The method for manufacturing a cosmetic material sheet according to claim 1, wherein the mount is formed of a resin sheet or a woodfree paper.

3. The method for manufacturing a cosmetic material sheet according to claim 2, wherein the resin sheet includes polypropylene.

4. The method for manufacturing a cosmetic material sheet according to claim 3, wherein the polypropylene resin sheet has a thickness of 6 to 400 μm.

5. The method for manufacturing a cosmetic material sheet according to claim 3, wherein the polypropylene resin sheet has a thickness of 100 to 200 μm.

6. A device for manufacturing a cosmetic material sheet comprising:

a supply device which supplies a mount which has a plurality of concave portions formed on an upper surface thereof, wherein the depth of the concave portions is within a range of 1 to 500 μm, wherein the lateral width of the concave portions is within a range of 50 to 2000 μm, wherein the longitudinal width of the concave portions is within a range of 50 to 2000 μm;

a filling device which fills powdery cosmetic material on the upper surface of the mount wherein the powdery cosmetic material covers the concave portions to form a powdery cosmetic material adhering layer;

a pressing device which presses the powdery cosmetic material;

a means for clearing the upper surface of the mount of powdery cosmetic material;

a laminating device which adheres lamination material to the upper surface of the mount, wherein the lamination material is releasably adherent, wherein the lamination material comprises a window portion that is smaller than the powdery cosmetic material adhering layer; and a cutting device which cuts the mount on a non-window portion of lamination material to obtain a cut piece as a cosmetic material sheet.

7. The device for manufacturing a cosmetic material sheet according to claim 6, wherein the mount is formed of a resin sheet or a woodfree paper.

8. The device for manufacturing a cosmetic material sheet according to claim 7, wherein the resin sheet includes polypropylene.

9. The device for manufacturing a cosmetic material sheet according to claim 8, wherein the polypropylene resin sheet has a thickness of 6 to 400 μm.

10. The device for manufacturing a cosmetic material sheet according to claim 8, wherein the polypropylene resin sheet has a thickness of 100 to 200 μm.

11. The device for manufacturing a cosmetic material sheet according to claim 6, wherein the filling device comprises a printing plate.

12. The device for manufacturing a cosmetic material sheet according to claim 6, wherein the filling device comprises a brush.

13. The device for manufacturing a cosmetic material sheet according to claim 6, wherein the filling device comprises a powdery cosmetic material supply means.

14. The device for manufacturing a cosmetic material sheet according to claim 6, wherein the filling device comprises a printing plate moving means.

15. The device for manufacturing a cosmetic material sheet according to claim 14, wherein the printing plate includes a mesh.

16. The device for manufacturing a cosmetic material sheet according to claim 6, wherein the filling device comprises a brush moving means.

17. The device for manufacturing a cosmetic material sheet according to claim 16, wherein the brush is moved in the upward and downward directions, and is made to flow down the powdery cosmetic material from the printing plate.

* * * * *